US005846367A

United States Patent [19]

Omote et al.

[11] Patent Number: 5,846,367

[45] Date of Patent: Dec. 8, 1998

[54] HEAT TRANSFER RECORDING METHOD AND INDIRECT TRANSFER MEDIUM TO BE USED THEREFOR

[75] Inventors: Hisahiro Omote; Akio Hoshino; Mitsuhide Hoshino; Masahide Takano, all of Higashimatsuyama, Japan

[73] Assignee: Nippon Paper Industries Co., Ltd., Tokyo, Japan

[21] Appl. No.: 771,421

[22] Filed: Dec. 20, 1996

[30] Foreign Application Priority Data

Dec. 25, 1995 [JP] Japan ..... 7-351007

[51] Int. Cl.[6] ..... B41M 5/025; B41M 5/26

[52] U.S. Cl. ..... 156/235; 156/277; 428/195; 428/474.4; 428/484; 428/500; 428/913; 428/914

[58] Field of Search ..... 156/235, 240, 156/241, 277; 428/195, 484, 488.1, 488.4, 913, 914, 474.4, 500; 503/227

[56] References Cited

FOREIGN PATENT DOCUMENTS 0 263 458 4/1988 European Pat. Off. .
0 576 840 1/1994 European Pat. Off. .
0 672 542 9/1995 European Pat. Off. .
2 243 332 10/1991 United Kingdom .
WO 94/05505 3/1994 WIPO .

*Primary Examiner*—Bruce H. Hess
*Attorney, Agent, or Firm*—Oblon, Spivak, McClelland, Maier & Neustadt, P.C.

[57] ABSTRACT

Disclosed is a heat transfer recording method that utilizes an indirect transfer medium with deformable layer deforming under heat and/or pressure and image-receiving layer having adhesiveness to the image formed by fusion type heat transfer recording of hot peeling mode and allowing to retransfer the formed image alone onto image receiver provided on a supporter in this order. In this indirect transfer medium, the constituting material of that deformable layer comprises a substance with softening temperature of not higher than 90° C. and stretch at breaking point of not less than 400%, and further the constituting material of the image-receiving layer contains a substance, in which the major component is acrylic resin comprising methyl methacrylate or/and hydroxyethyl methacrylate and this is graft copolymerized with hydroxyethyl methacrylate or/and N-methylol acrylamide.

The inventive recording method needs no exclusive image receiver and affords a high-quality record without transfer miss on various recording image receivers with different surface smoothnesses by transferring the recording image alone.

4 Claims, No Drawings

HEAT TRANSFER RECORDING METHOD AND INDIRECT TRANSFER MEDIUM TO BE USED THEREFOR

BACKGROUND OF THE INVENTION

The present invention relates to a multicolor image-forming method by heat transfer recording mode used for the displayer and signboard decoration as well as the color proof and color print for color calibration and an indirect transfer medium to be used therefor. Particularly, it relates to an image-forming method that allows to form a multicolor image on image receiver without exclusive image-receiving layer by fusion type heat transfer recording and an indirect transfer medium to be used therefor.

In recent years, as full-color image-recording modes, those such as heat transfer (fusion type heat transfer or sublimation type heat transfer), electrophotography and ink jet have been put into practice. Also, for the mode of color calibration (color proof) in the sector of printing and makeup, above-mentioned modes excellent in operativity and capable of simply recording many sheets have become to be utilized in place of Surprint mode called chemical proof that utilizes conventional photosensitive resin.

However, while the sublimation type heat transfer has a feature capable of reproducing the gradation of both images through modulation of density, because the amount of dye to be transferred sublimately can be changed by changing the thermal energy of heat source such as thermal head, it has also a drawback incapable of recording an image receivers without image-receiving layer such as plain paper and plastic film, because the image receiver with exclusive image-receiving layer that receives the sublimation type dye is needed for forming the image as a recording image-receiver. Moreover, since the color tone of ink layer differs from the color tone of printing ink, the reproduced color tone becomes not to strictly approximate that of print. Also, this point is similar in the ink jet mode. It has an advantage capable of recording on large-size item (larger than A0 size), thus having a feature suitable for recording on outdoor displayer etc., but it also needs the exclusive recording image receiver and, strictly saying, the reproduced color tone also becomes different from that in printing.

The fusion type heat transfer mode has an ink layer of coloring material mixed with heat-fusible binder, making it possible to use, for example, same coloring material as printing ink. It allows to record the image alone on recording image receiver similarly to print, and the like, so it has a possibility to become color proof for color calibration. However, while this mode is endowed with a feature that no special image-receiving layer is needed as an image receiver, it also has a drawback that, unless the surface of recording image receiver (accepting face for image layer) is excellent in the smoothness, high-quality imaging cannot be achieved. For example, if imaging on paper poor in the smoothness, the image layer may be transferred only onto hill portions of paper surface and the image layer may not be transferred onto valley portions, resulting in an inconvenience of generation of image miss in recorded image area.

Hence, a method of obtaining high-quality record without transfer miss also on paper poor in the surface smoothness by contriving the constitution of heat transfer recording medium and the material to be used for ink layer, as disclosed in Japanese Unexamined Patent Publication Nos. Hei 4-220390, Hei 7-137470, etc., a method of obtaining high-quality record without transfer miss also on paper poor in the surface smoothness by providing an intermediate transfer medium in heat transfer recording apparatus, primarily transferring the recording image onto the intermediate transfer medium, and thereafter retransferring it onto image receiver, as disclosed in Japanese Unexamined Patent Publication No. Sho 58 162355 etc., and further a method of uniformly layering a donor sheet with peelable thin film (fusion type heat transfer recording material) and an image-receiving material (indirect transfer medium referred to so in the present invention) with peelable image-receiving layer (image-receiving layer referred to so in the present invention), next image-wise impressing thermal energy, thereby imaging-wise decreasing the adhesive force of thin film of donor sheet to form the image on image-receiving layer (peeling development), and thereafter transferring the image formed on image-receiving layer from image-receiving material onto permanent supporter (image receiver referred to so in the present invention), as disclosed in Japanese Unexamined Patent Publication No. Hei 7-290731 etc. have been proposed so far.

As one of the qualities required for color proof for color calibration in the printing sector, it is said to be ideal to have a color proof prepared on the same paper as printing paper to be printed actually on commercial machine. Hence, similarly in the case of making color proof by fusion type heat transfer recording mode, a mode with such function that responds to extensive types of printing papers and can record the image alone on image receiving similarly to print has been desired.

However, while the methods disclosed in Japanese unexamined Patent Publication Nos. Hei 4-220390, Hei 7-137470, Sho 58-162355. etc. are provided with an advantage capable of recording the image alone on image receiving similarly to conventional fusion type heat transfer recording mode and, at the same time, improve the recording quality on image receiver poor in the smoothness compared with conventional one, they have not yet achieved the satisfiable recording quality on all of printing papers (coated paper, fine paper,-lower grade paper, newsprint, etc.) with a variety of smoothnesses.

Moreover, in the method disclosed in Japanese Unexamined Patent Publication No. Hei 7-290731 etc., the image-receiving layer of image-receiving material is constructed to be peelable, thereby the image recorded on image-receiving layer is transferred onto permanent supporter together with image- receiving layer. This method allows therefore recording without transfer miss even on printing papers with a variety of smoothnesses, but, because of incapability of recording the image alone on permanent supporter, the finish results in different one from print (because of image-receiving layer transferred also onto nonimage area of permanent supporter, the aesthetic property differs from that of print).

In view of the above-mentioned points, the purpose of the invention is to provide a recording method, which, in the fusion type heat transfer recording mode, needs no exclusive image receiver, causes no transfer miss even on various image receivers with different surface smoothnesses and allows to record the image alone on image receiver similarly to print, and a material therefor.

Such problems to be solved by the invention can be solved as follows.

SUMMARY OF THE INVENTION

The invention provides a heat transfer recording method comprising the steps of facing an indirect transfer medium with deformable layer of deforming under heat and/or pressure and image-receiving layer having adhesiveness to the image formed by fusion type heat transfer recording and having retransferability of transferred image onto image receiver provided on a supporter in this order, and an ink layer of fusion type heat transfer recording material with fusible and heat-transferable ink layer containing binder having thermoplastic resin as a major component provided on a supporter, each other, imaging-wise heating from the backside of fusion type heat transfer imaging material or the backside of indirect transfer medium, peeling off the fusion type heat transfer recording material from the indirect transfer medium prior to cooling and solidification of ink to form an image on the image-receiving layer of indirect transfer medium, and then retransferring said image alone onto image receiver, and an indirect transfer medium with particular feature to be used therefor.

DETAILED DESCRIPTION OF THE INVENTION

So far, as the image-recording modes of fusion type heat transfer recording material, there are cold peeling mode, wherein the fusion type heat transfer recording material (ink ribbon or the like) is peeled off from the recording medium after solidification of ink, and hot peeling mode, wherein the fusion type heat transfer recording material is peeled off from the recording medium before solidification of ink.

In the case of cold peeling mode, however, when superposing the surface of ink layer of fusion type heat transfer recording material on the surface of image-receiving layer of retransferable indirect transfer medium and transferring the ink onto image-receiving layer using thermal head, laser or the like, it is required to selectively transfer the ink layer correspondently to nonimaging-wise heating area and, for obtaining high image quality, to select the coated film of ink layer with both low shearing breaking strength and low stretch and yet high affinity and high wettability to image-receiving layer. Hence, material to constitute the ink layer and material to constitute the image-receiving layer are to be selected from those having physical properties such as value of solubility parameter SP close to each other. For this reason, the affinity between the image transferred and formed on image-receiving layer and the image-receiving layer becomes strong, hence, upon retransferring finally onto image receivers (printing paper etc.), it becomes difficult to transfer the image alone.

In this case, therefore, a method of transferring the image onto image receiver together with image-receiving layer is used by providing with peelable image-receiving layer as a constitution of indirect transfer medium.

Whereas, in the invention, a material having thermoplastic resin as a major component is used for the binder in ink layer and, after image-wise heating, the fusion type heat transfer material is peeled off from the indirect transfer medium having particular feature before cooling and solidification of ink (hot peeling mode) to transfer the image onto image-receiving layer of indirect transfer medium, thereby, it has become possible to retransfer the image alone on image-receiving layer onto image receivers (printing paper etc.) thereafter.

That is to say, by selecting a thermoplastic resin-based material for the binder in ink layer and peeling off the fusion type heat transfer recording material from the indirect transfer medium before cooling and solidification of ink (when ink is still in the fused state) (hot peeling mode), it has been found that, without using material with high affinity and wettability to ink layer as a material to be used for the image-receiving layer of indirect transfer medium, high-quality image can be obtained. Consequently, the affinity between the image transferred and formed on image-receiving layer and the image-receiving layer is weak in this case, making it possible to easily retransfer the image alone onto image receivers (printing paper etc.) finally.

In following, the invention will be illustrated in more detail.

First, the fusion type heat transfer recording material will be explained. The recording material to be used in the invention basically has a structure with ink layer containing binder having not peeling type thermoplastic resin as a major component layered on supporter, and,if need be, an intermediate layer (release layer, deformable layer or light-heat conversion layer) may be provided between supporter and ink layer.

The binder to be used for the ink layer of fusion type heat transfer recording material is mainly composed of thermoplastic resin suitable for hot peeling mode and, if need be, small amount of waxy substance etc. may be formulated. As said resins, for example, ethylenic copolymers such as ethylene-vinyl acetate copolymer, ethylene-alkyl (meth) acrylate copolymer (for alkyl groups, those with carbon atoms of around 1 to 16 such as methyl, ethyl, propyl, butyl, hexyl, heptyl, octyl, 2-ethylhexyl, nonyl, dodecyl and hexadecyl are mentioned), ethylene-acrylonitrile copolymer and ethylene-styrene copolymer: poly(lauryl(meth)acrylat)s; vinyl chloride-based (co)polymers such as poly(vinyl chloride), vinyl chloride-vinyl acetate copolymer and vinyl chloride-vinyl alcohol copolymer; and the like can be mentioned. Thereamong, particularly, ethylene-vinyl acetate copolymer is preferable from the points of high viscosity on fusion and excellent temporary adhesiveness.

As said waxy substances, for example, natural waxes such as vegetable wax, bees wax, carnauba was, candelilla wax, montan wax and ceresin wax; petrolic waxes such as paraffin wax and miscrocrystalline wax, synthetic waxes such as oxidized wax, ester wax, polyethylene wax, Fischer-Tropsch wax and α-olein-maleic anhydride copolymer wax; higher fatty acids such as myristic acid, palmitic acid, stearic acid and behenic acid; higher aliphatic alcohols such as stearyl alcohol and docosanol; esters such as high fatty acid monoglyceride, fatty acid esters of sucrose and fatty acid esters of sorbitan; amides such as stearic amide and oleyl amide and bisamides; and the like can be mentioned.

Moreover, for the coloring agents to be used for ink layer, those having been used hitherto as the coloring agents for heat-fusible inks of this type can all be used and various inorganic and organic pigments and dyes are used appropriately.

As the image-wise heating methods of ink layer, a method of imaging-wise heating the ink layer by thermal head etc., a method of image-wise heating the image layer by light after giving the light-heat conversion function to fusion type heat transfer recording material, and the like can be utilized.

Moreover, as the apparatus that allows the hot peeling mode, a mode of shortening the distance from heat-generating portion of thermal head to ink ribbon-peeling edge portion, as disclosed in Japanese Unexamined Patent Publication No. Hei 7- 81113 etc., can be utilized.

Next, the indirect transfer medium to be used in the invention will be explained. The inventive indirect transfer medium has a deformable layer and an image-receiving layer in this order on supporter, and, if need be, an adhesive layer may be provided between supporter and deformable layer or between deformable layer and image-receiving layer for the purpose of adhering each interface (supporter/deformable layer or deformable layer/iumage-receiving layer).

For the supporter of indirect transfer medium, sheet-like materials such as plastic film publicly known hitherto can be utilized. For example, plastic films such as poly(ethylene terephthalate), polypropylene, polyethylene, poly(vinyl chloride), polystyrene, polycarbonate and triacetate, or metal plates such as aluminum plate and zinc plate can be utilized. Moreover, since the ink layer fused by heat is transferred, materials with moderate heat resistance and excellent dimensional stability are preferable, and, from the viewpoint of handling, poly(ethylene terephthalate) film, polycarbonate film, etc. are suitable, but the supporter is not restricted particularly thereto. Furthermore, the transparency of supporter is not restricted.

Moreover, the thickness of supporter is not restricted particularly, but, from the viewpoint of operativity etc., it is preferably 25 μm to 200 μm, more preferably 50 μm to 150 μm.

With respect to the organic high-molecular substance to be used for the deformable layer of indirect transfer medium, it is a preferable embodiment capable of realizing the effect of the invention that the softening temperature is not higher than 90° C. under the standard test conditions in JIS K 6730 and the stretch at breaking point is not lower than 400% under the standard test conditions in JIS K 6760.

This reason is because of that, by using an organic high-molecular substance with softening temperature as low as 90° C. or lower, when forming the retransferable image on indirect transfer medium and then transferring said image onto image receiver such as paper under pressure and heat, the deformable layer of indirect transfer medium is softened, thereby causing the deformation of deformable layer adapting to the irregularities, resulting in even and close adhesion of said image to image receiver. When using an organic high-molecular substance with softening temperature over 90° C., it is needed to transfer at higher temperature, and, when using an organic high-molecular substance with stretch at breaking under 400%, it is needed to transfer under higher pressure; both cases are unpreferable because of significant harmful effect on the dimensional stability of image.

For such reason, the softening temperature of organic high-molecular substance to be used for deformable layer is preferable to be between not higher than 90° C., preferably not higher than 60° C. and not lower than −100° C., and the stretch at breaking point is preferable to be between not lower than 400%, preferably not lower than 500% and not higher than 1000%.

The organic high-molecular substance that can be used for deformable layer cannot be regulated by the type of prime material, but, as the concrete examples of preferable materials, polyolefins such as polyethylene and polypropylene, ethylene copolymers such as ethylene-vinyl acetate, ethylene-acrylic acid, ethylene-acrylic ester and copolymer of ethylene with α,β-unsaturated carboxylic acid, poly(vinyl chloride), vinyl chloride copolymers such as vinyl chloride with vinyl acetate, polystyrene, styrene copolymers such as styrene with (meth)acrylic ester, poly((meth)acrylic ester), copolymers of (meth)acrylic ester such as butyl (meth)acrylate-vinyl acetate, and the like can be mentioned.

The thickness of deformable layer is not less than 5 μm. more preferably not less than 10 μm and not more than 80 μm. The reason is due to that, by making thicker than the irregularities of the surface of image receiver (coated paper, fine paper or newsprint) to be transferred for recording, the image can be transferred along the irregularities of image receiver on retransferring, and further due to that, in the case of color proof, for example, when transferring four-color image onto image receiver, there exist the irregularities in image area and nonimage area of each color, hence a thickness corresponding to the thickness of that image layer becomes necessary in the areas where four colors were transferred onto the same portion.

Moreover, when retransferring the image having been transferred onto image-receiving layer onto image receiver, it is preferable to submit the surface of deformable layer to corona discharge treatment for retransferring the image alone. Thereby, the adhesive force between deformable layer and image-receiving layer improves, resulting in easier retransfer of image alone onto image receiver.

When forming the ink layer by appropriately mixing the thermoplastic resin, waxy substance, coloring agent, etc. in above-mentioned examples, employing the fusion type heat transfer recording material used it, performing the image formation on indirect transfer medium by hot peeling mode and retransferring said image onto image receiver, an image-receiving layer of indirect transfer medium containing a substance, in which the major component is acrylic resin comprising methyl methacrylate or/and hydroxyethyl methacrylate and this is graft copolymerized with hydroxyethyl methacrylate or/and N-methylol acrylamide, showed excellent image-accepting ability as an image-receiving layer, and, upon retransferring onto image receiver, it was effective as a material that allowed to transfer the image alone onto image receiver and did not allow to transfer any layer except image onto image receiver.

Moreover, if need be, additives such as other resin or plasticizer, matting agents (inorganic particles such as silicon dioxide, calcium carbonate and aluminum powder, organic particles such as polyethylene, polypropylene and polystyrene, and the like) and wettability improver may be mixed to the extent not injuring the necessary performance.

The thickness of image-receiving layer is preferable to be 0.1 to 5 μm, more preferably 0.1 to 3 μm. The reason is due to that, if the image-receiving layer becomes thicker over said range, then the performance of deformable layer under image-receiving layer is to be injured, making it impossible to perform high-quality image recording without transfer miss adapting to the irregularities of the surface of image receiver such as paper.

A method of retransferring the image having been formed on image-receiving layer of indirect transfer medium onto image receiver will be explained. As an apparatus, one provided with the mechanism of laminator etc. is suitable and is preferable to be heated uniformly to a temperature of 80° C. to 150° C. and simultaneously pressurized under a linear pressure of not lower than 1 kg/cm. When transferring only by pressure, it is preferable to be pressurized under a linear pressure of not lower than 2 kg/cm.

For the materials of image receiver, paper, plastic sheet, woven fabric, metal plate, etc. are used. Even the paper with poor smoothness can be used suitably, and the subjects are printing paper and materials for printing which receive rough color printing.

In following, the invention will be illustrated more concretely based on the examples, but the invention is not confined to following examples.

Besides, "part" in the examples means "part by weight".

EXAMPLE 1

(Method of producing indirect transfer medium)

On a 100 μm-thick biaxially stretched poly(ethylene terephthalate) film, following deformable layer-forming resin A was formed in a thickness of 50 μm by extrusion coating method. After submitted the deformable layer to corona discharge treatment, image-receiving layer-forming liquor A was coated thereon by wire bar coating method and then dried to provide 2 μm-thick image-receiving layer in sequence.

<Deformable layer-forming resin A>

Ethylene-ethyl acrylate copolymer resin (Evaflex-EEA A-701: From Du Pont-Mitsui Polychemicals Co.)

<Image-receiving layer-forming liquor A>

| | |
|---|---|
| Trunk chain composition Poly(methyl methacrylate) | |
| Branch chain composition Poly(2-hydroxyethyl methacrylate) (Comb-shaped polymer L-20 (25% liquor): From Soken Kagaku Co.) | 40 parts |
| Toluene | 30 parts |
| Methyl ethyl ketone | 30 parts |

EXAMPLE 2

(Method of producing indirect transfer medium)

On a 100 μm-thick biaxially stretched poly(ethylene terephthalate) film, following deformable layer-forming resin B was formed in a thickness of 30 μm by extrusion coating method. After submitted the deformable layer to corona discharge treatment, image-receiving layer-forming liquor B was coated thereon by wire bar coating method and then dried to provide 1 μm-thick image-receiving layer in sequence.

<Deformable layer-forming resin B>

Ethylene-methacrylic acid copolymer resin (Nuclar 1108C: From Du Pont-Mitsui Polychemicals Co.)

<Image-receiving layer-forming liquor B>

| | |
|---|---|
| Trunk chain composition Poly(methyl methacrylate) | |
| Branch chain composition Poly(N-methylol acrylamide/2-hydroxyethyl methacrylate) (Comb-shaped polymer L-40M (25% liquor): From Soken Kagaku Co.) | 40 parts |
| Toluene | 30 parts |
| Methyl ethyl ketone | 30 parts |

EXAMPLE 3

(Method of producing indirect transfer medium)

On a 100 μm-thick biaxially stretched poly(ethylene terephthalate) film, following deformable layer-forming resin C was formed in a thickness of 20 μm by extrusion coating method. After submitted the deformable layer to corona discharge treatment, image-receiving layer-forming liquor C was coated thereon by wire bar coating method and then dried to provide 3 μm-thick image-receiving layer in sequence.

<Deformable layer-forming resin C>

Ethylene-vinyl acetate copolymer resin (Evaflex-250: From Du Pont-Mitsui Polychemicals Co.)

<Image-receiving layer-forming liquor C>

| | |
|---|---|
| Trunk chain composition Poly(methyl methacrylate/hydroxyethyl methacrylate) | |
| Branch chain composition Poly(N-methylol acrylamide) (Comb-shaped polymer LH-448 (25% liquor): From Soken Kagaku Co.) | 40 parts |

-continued

| | |
|---|---|
| Toluene | 30 parts |
| Methyl ethyl ketone | 30 parts |

EXAMPLE 4

(Method of producing indirect transfer medium)

On a 100 μm-thick biaxially stretched poly(ethylene terephthalate) film, the deformable layer-forming resin A was formed in a thickness of 50 μm by extrusion coating method. After submitted the deformable layer to corona discharge treatment, image-receiving layer-forming liquor B was coated thereon by wire bar coating method and then dried to provide 1 μm-thick image-receiving layer in sequence.

EXAMPLE 5

(Method of producing indirect transfer medium)

On a 100 μm-thick biaxially stretched poly(ethylene terephthalate) film, the deformable layer-forming resin B was formed in a thickness of 60 μm by extrusion coating method. After submitted the deformable layer to corona discharge treatment, image-receiving layer-forming liquor C was coated thereon by wire bar coating method and then dried to provide 2 μm-thick image-receiving layer in sequence.

EXAMPLE 6

(Method of producing indirect transfer medium)

On a 100 μm-thick biaxially stretched poly(ethylene terephthalate) film, the deformable layer-forming resin C was formed in a thickness of 30 μm by extrusion coating method. After submitted the deformable layer to corona discharge treatment, image-receiving layer-forming liquor A was coated thereon by wire bar coating method and then dried to provide 1 μm-thick image-receiving layer in sequence.

Comparative Example 1

(Method of producing indirect transfer medium)

On a 100 μm-thick biaxially stretched poly(ethylene terephthalate) film, following deformable layer-forming resin D was formed in a thickness of 30 μm by extrusion coating method. Then, onto that deformable layer, image-receiving layer-forming liquor D was coated by wire bar coating method and then dried to provide 1 μm-thick image-receiving layer in sequence.

<Deformable layer-forming resin D>

Ionomer resin (Himilan AM7902: From Du Pont-Mitsui Polychemicals Co.)

<Image-receiving layer-forming liquor D>

| | |
|---|---|
| Polyester resin (Bironal MD-1400: From Toyobo Co.) | 10 parts |
| Isopropyl alcohol | 45 parts |
| Water | 45 parts |

Comparative Example 2

(Method of producing indirect transfer medium)

On a 100 μm-thick biaxially stretched polyethylene terephthalate) film, only the deformable layer with a thickness of 40 μm was provided by extrusion coating method using following deformable layer-forming resin D.

<Deformable layer-forming resin D>

Ionomer resin (Himilan AM7208: From Du Pont-Mitsui Polychemicals Co.)

Using above-mentioned indirect transfer media (Examples 1 through 6 and Comparative examples 1 and 2), the imaging test was performed with following fusion type heat transfer recording materials for hot peeling mode, heat transfer recording apparatus and laminator as a retransfer apparatus, the evaluation results of which are shown in Table 1.

Fusion type heat transfer recording material: From Alps Electric Co.
Ink cassette.for paper.black (MDC-FLCK)
Ink cassette.for paper.yellow (MDC-FLCY)
Ink cassette.for paper.magenta (MDC-FLCM)
Ink cassette.for paper.cyan (MDC-FLCC)

Heat transfer recording apparatus: From Alps Electric Co. Micro Dry Process Printer MD-2000S Laminator: From Nippon Paper Industries Co.
Star Proof Laminator SPL-005
Roll temperature: 110° C., Conveying speed: 400 mm/min Image receiver: Three types of coated paper (Oken smoothness 5000 sec), PPC paper (Oken smoothness 50 sec) and newsprint (Oken smoothness 20 sec)

TABLE 1

| | Example 1 | Example 2 | Example 3 | Example 4 | Example 5 | Example 6 | Comparative example 1 | Comparative example 2 |
|---|---|---|---|---|---|---|---|---|
| *1 Evaluation of primary transferability | ○ | ○ | ○ | ○ | ○ | ○ | ○ | ○ |
| *2 Evaluation of secondary transferabiity | A B C<br>○ ○ ○ | A B C<br>○ ○ ○ | A B C<br>○ ○ ○ | A B C<br>○ ○ ○ | A B C<br>○ ○ ○ | A B C<br>○ ○ ○ | A B C<br>X X X | A B C<br>○ X X |

*1 Recording from fusion type heat transfer recording material to indirect transfer medium
*2 Recording from indirect transfer medium to image receiver (Retransfer)
A: Coated paper (Oken smoothness 5000 sec)
B: PPC paper (Oken smoothness 50 sec)
C: Newsprint (Oken smoothness 20 sec)
○: Good tranferability, X; Poor because of transfer of image-receiving layer itself onto image receiver As evident from Table 1, if using the inventive heat transfer recording method and indirect transfer medium, it is possible to record the recording image alone on various image receivers with different surface smoothnesses, and high-quality record that does not injure the quality feeling of image receiver can be produced.

What is claimed is:

1. A heat transfer recording method comprising the steps of imagewise contacting an indirect transfer medium comprising a deformable layer deforming under heat and/or pressure and an image-receiving layer having adhesiveness to an image formed by fusion type heat transfer recording and having retransferability of a transferred image onto an image receiver provided on a supporter in this order, with an ink layer of a fusion type heat transfer recording material with a fusible and heat-transferable ink layer containing binder having thermoplastic resin as a major component provided on a supporter, imagewise heating from the backside of the fusion type heat transfer imaging material or the backside of the indirect transfer medium, peeling off while hot the fusion type heat transfer recording material from the indirect transfer medium prior to cooling and solidification of ink to form an image on the image-receiving layer of indirect transfer medium, and then retransferring only said image onto the image receiver.

2. The method according to claim 1, wherein the indirect transfer medium comprises an organic high-molecular substance with a softening temperature of not lower than −100° C. and not higher than 90° C. under the standard test conditions in JIS K 6730 comprising the deformable layer.

3. The method according to claim 2, wherein the indirect transfer medium comprises an organic high-molecular substance with stretch at breaking point of not less than 400% and not more than 1000% under the standard test conditions in JIS K 6760 comprising the deformable layer.

4. The method according to claim 2, wherein the indirect transfer medium comprises a substance, in which the major component is acrylic resin comprising methyl methacrylate or/and hydroxyethyl methacrylate and this is graft copolymerized with hydroxyethyl methacrylate or/and N-methylol acrylamide as a component of said organic high-molecular substance.

* * * * *